US011204570B2

(12) United States Patent
Nanno et al.

(10) Patent No.: US 11,204,570 B2
(45) Date of Patent: Dec. 21, 2021

(54) CONTACT-SEPARATION MECHANISM, FIXING DEVICE, AND IMAGE FORMING APPARATUS

(71) Applicant: Ricoh Company, Ltd., Tokyo (JP)

(72) Inventors: Shigeo Nanno, Kanagawa (JP); Kimihiro Tanaka, Kanagawa (JP); Tamotsu Ikeda, Tokyo (JP); Kenji Tomita, Tokyo (JP); Osamu Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 256 days.

(21) Appl. No.: 16/594,772

(22) Filed: Oct. 7, 2019

(65) Prior Publication Data

US 2020/0172359 A1 Jun. 4, 2020

(30) Foreign Application Priority Data

Nov. 29, 2018 (JP) ..... JP2018-223764

(51) Int. Cl.

| | |
|---|---|
| ***G03G 15/20*** | (2006.01) |
| ***B65H 5/06*** | (2006.01) |
| ***B65H 7/02*** | (2006.01) |
| ***B65H 3/06*** | (2006.01) |

(Continued)

(52) U.S. Cl.

CPC ..... *G03G 15/2032* (2013.01); *B65H 3/0676* (2013.01); *B65H 5/068* (2013.01); *B65H 7/02* (2013.01); *B65H 29/20* (2013.01); *G03G 15/751* (2013.01); *G03G 15/754* (2013.01); *B65H 2403/51* (2013.01); *B65H 2404/1441* (2013.01);

(Continued)

(58) Field of Classification Search

CPC ..... G03G 15/2032; G03G 15/2035; B65H 2403/51; B65H 2404/144; B65H 2404/1441; B65H 2404/1451; B65H 5/068; B65H 7/02; B65H 3/0676; B65H 29/20; B65H 2555/25; B65H 2513/10

See application file for complete search history.

(56) References Cited

U.S. PATENT DOCUMENTS

| | | | | |
|---|---|---|---|---|
| 8,385,763 | B2 * | 2/2013 | Tsukioka | G03G 15/2032 399/67 |
| 10,191,423 | B2 * | 1/2019 | Sugiyama | G03G 15/2064 |
| 10,228,050 | B2 * | 3/2019 | Nieda | G03G 15/2053 |

(Continued)

FOREIGN PATENT DOCUMENTS

| | | |
|---|---|---|
| JP | 2005-231564 | 9/2005 |
| JP | 2007-164106 | 6/2007 |

(Continued)

*Primary Examiner* — Jeremy R Severson

(74) *Attorney, Agent, or Firm* — Harness, Dickey & Pierce, P.L.C.

(57) ABSTRACT

A contact-separation mechanism includes a cam to rotate to move a contact-separation member to and from a counterpart member, a detection target to rotate together with the cam, and a detector to detect presence or absence of the detection target in a detection area of the detector, and circuitry. The cam has a reference range. The circuitry issues a rotation stop instruction of the cam after a target time elapses from passing of the reference range of the detection target through the detection area, and sets the target time based on a duration of an immediately preceding passing of the reference range through the detection area.

7 Claims, 14 Drawing Sheets

(51) Int. Cl.
*B65H 29/20* (2006.01)
*G03G 15/00* (2006.01)

(52) U.S. Cl.
CPC .... *B65H 2511/224* (2013.01); *B65H 2513/10* (2013.01); *B65H 2555/25* (2013.01)

(56) References Cited

U.S. PATENT DOCUMENTS

| | | | | |
|---|---|---|---|---|
| 2009/0297181 | A1* | 12/2009 | Yamanaka ..... | G03G 15/2032 399/33 |
| 2011/0222887 | A1* | 9/2011 | Tao ..... | G03G 15/2039 399/68 |
| 2015/0220033 | A1 | 8/2015 | Shiga et al. | |
| 2018/0112762 | A1 | 4/2018 | Nieda | |
| 2019/0250540 | A1 | 8/2019 | Tomita | |

FOREIGN PATENT DOCUMENTS

| | | |
|---|---|---|
| JP | 2012-234073 | 11/2012 |
| JP | 2014-089416 | 5/2014 |
| JP | 2016-018054 | 2/2016 |
| JP | 2018-072792 | 5/2018 |

* cited by examiner

CONTACT-SEPARATION MECHANISM, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-223764, filed on Nov. 29, 2018, in the Japan Patent Office, the entire disclosure of which is incorporated by reference herein.

BACKGROUND

Technical Field

The present disclosure relates to a contact and separation mechanism (hereinafter "contact-separation mechanism") which rotates a cam to move a movable member (a contact-separation member) to and from a counterpart member, a fixing device including the contact-separation mechanism, and an image forming apparatus.

Discussion of the Background Art

In some image forming apparatuses, a fixing device, a transfer device, or the like includes a contact-separation mechanism which brings and separates opposed rollers and the like closer to and from each other.

SUMMARY

According to an embodiment of this disclosure, a contact-separation mechanism includes a cam to rotate to move a contact-separation member to and from a counterpart member, a detection target to rotate together with the cam, and a detector to detect presence or absence of the detection target in a detection area of the detector, and circuitry. The cam has a reference range. The circuitry issues a rotation stop instruction of the cam after a target time elapses from passing of the reference range of the detection target through the detection area, and sets the target time based on a duration of an immediately preceding passing of the reference range through the detection area.

According to another embodiment, a fixing device includes a fixing rotator, a pressure rotator pressed against the fixing rotator, and the contact-separation mechanism described above. The contact-separation mechanism moves at least one of the fixing rotator and the pressure rotator closer to and from the other of the fixing rotator and the pressure rotator.

According to yet another embodiment, an image forming apparatus includes an image forming device configured to form an image, and the contact-separation mechanism described above.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
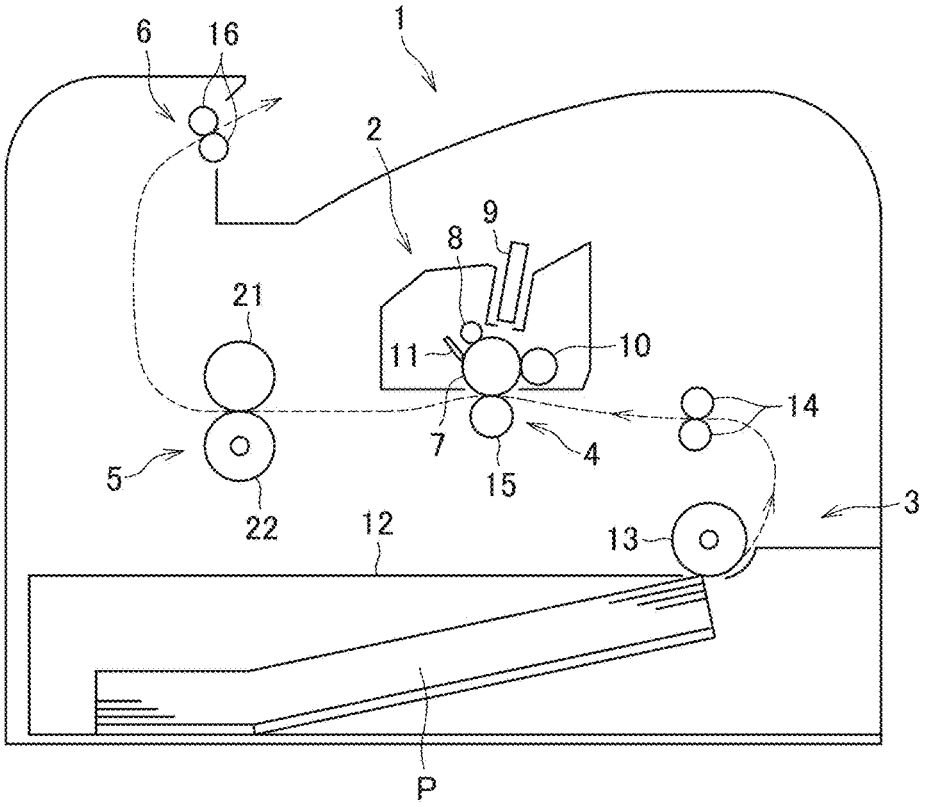
FIG. 1 is a view illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic view of an image forming apparatus according to an embodiment of this disclosure. Referring to FIG. 1, a configuration and operation of the image forming apparatus according to the present embodiment are described below.

An image forming apparatus 1 illustrated in FIG. 1 is a monochrome electrophotographic laser printer. The image forming apparatus 1 according to the embodiments of the present disclosure can be a copier, a facsimile machine, a multifunction peripheral (MFP) having at least two of copying, printing, scanning, facsimile, and plotter functions, not limited to the printer. The image forming apparatus 1 is not limited to a monochrome image forming apparatus and can be a color image forming apparatus.

As illustrated in FIG. 1, the image forming apparatus 1 includes an image forming device 2 to form an image, a recording medium feeding device 3 to feed a sheet P as a recording medium, a transfer device 4 to transfer the image onto the fed sheet P, a fixing device 5 to fix the image transferred onto the sheet P, and a sheet ejection device 6 to eject the sheet P with the fixed image to an outside of the image forming apparatus 1.

The image forming device 2 includes a drum-shaped photoconductor 7, a charging roller 8 as a charging device to charge a surface of the photoconductor 7, an exposure device 9 as a latent image forming device that exposes the surface of the photoconductor 7 to form an electrostatic latent image on the photoconductor 7, a developing roller 10 as a developing device that supplies toner as a developer to the surface of the photoconductor 7 to visualize the electrostatic latent image, and a cleaning blade 11 as a cleaner to clean the surface of the photoconductor 7.

As the start of image forming operation is instructed, in the image forming device 2, the photoconductor 7 starts rotating, and the charging roller 8 uniformly charges the surface of the photoconductor 7 to a high potential. Next, based on image data of a document read by a scanner or print data transmitted by a terminal device, the exposure device 9 exposes the surface of the photoconductor 7. Then, the potential of an exposed surface drops, and the electrostatic latent image is formed on the photoconductor 7. The developing roller 10 supplies toner to the electrostatic latent image, thereby developing the latent image into a toner image on the photoconductors 7.

The toner image formed on the photoconductor 7 is transferred onto the sheet P in a transfer nip between the photoconductor 7 and a transfer roller 15 disposed in the transfer device 4. The sheet P is fed from the recording medium feeding device 3. In the recording medium feeding device 3, a sheet feeding roller 13 feeds the sheet P from a sheet tray 12 to a feeding path one by one. A timing roller pair 14 sends out the sheet P fed from the sheet tray 12 to the transfer nip, timed to coincide with the toner image on the photoconductor 7. The toner image on the photoconductor 7 is transferred onto the sheet P in the transfer nip. After the toner image is transferred from the photoconductors 7 onto the sheet P, the cleaning blade 11 removes residual toner on the photoconductor 7.

The sheet P bearing the toner image is conveyed to the fixing device 5. When the sheet P passes through between a fixing roller 21 and a pressure roller 22, the fixing device 5 fixes the toner image on the sheet P with heat and pressure. Subsequently, the sheet P is conveyed to the sheet ejection device 6, and an ejection roller pair 16 ejects the sheet P outside the image forming apparatus 1. Then, a series of print operations completes.

Next, a configuration of a fixing device 5 is described with reference to FIGS. 2 to 6.

Figure 2:
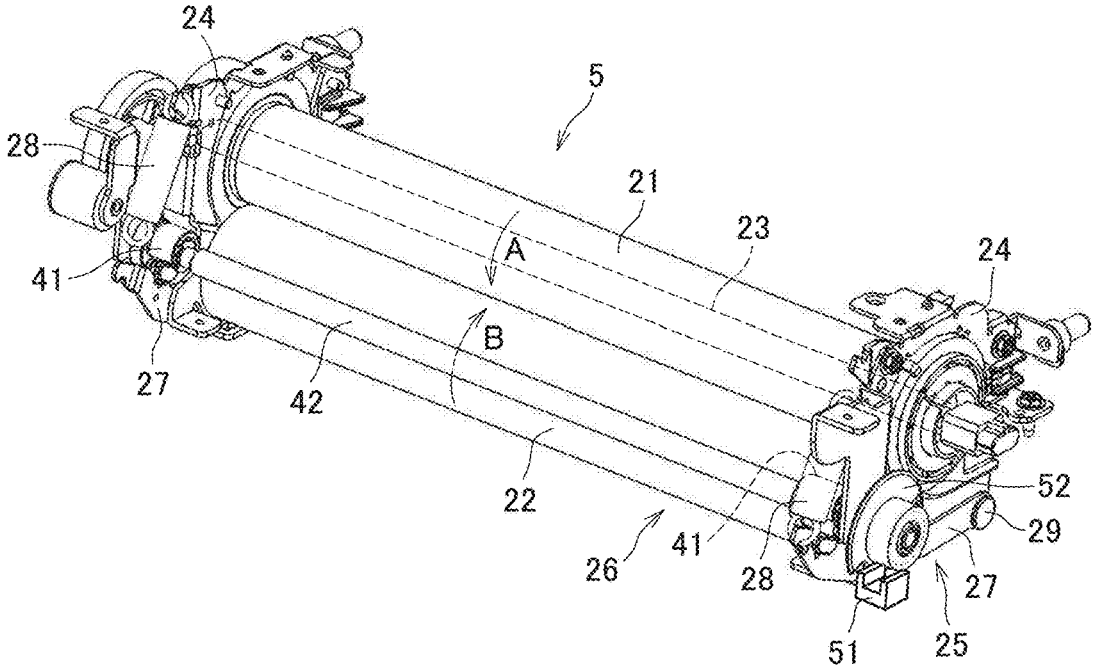
FIG. 2 is a perspective view of a fixing device according to an embodiment.
Figure 3:
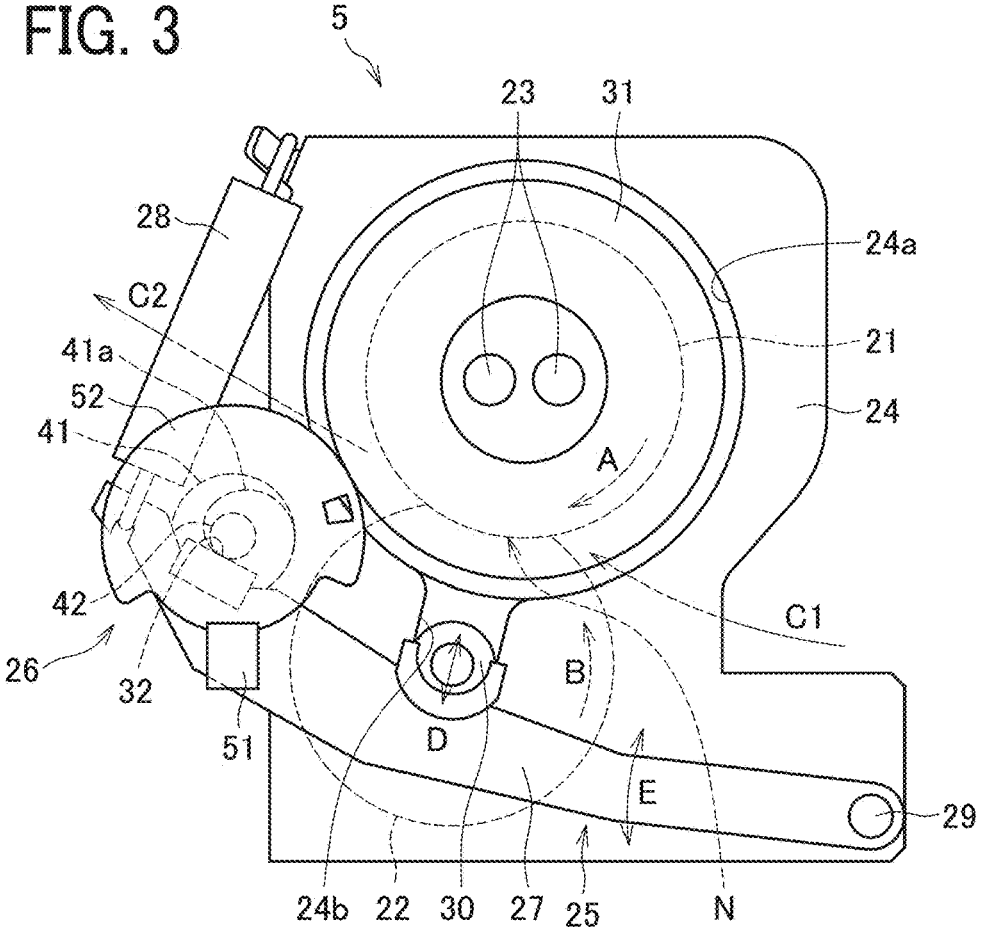
FIG. 3 is a side view of the fixing device.
Figure 4:
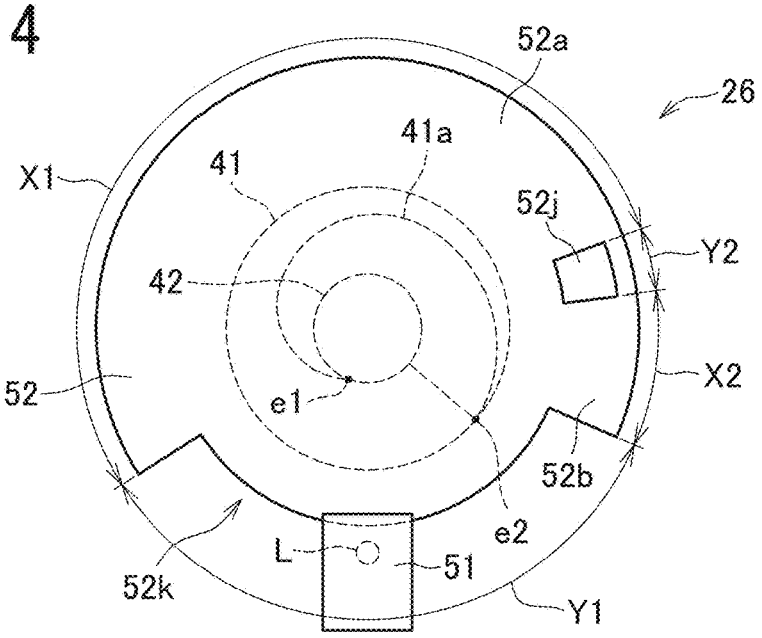
FIG. 4 is a side view of a contact-separation mechanism included in the fixing device.
Figure 5:
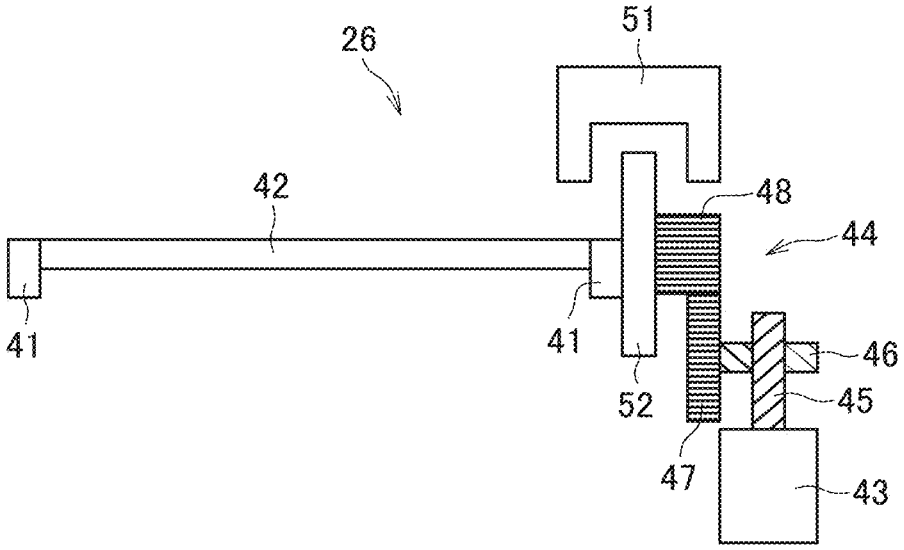
FIG. 5 is a view illustrating a schematic configuration of a drive system of the contact-separation mechanism.
Figure 6:
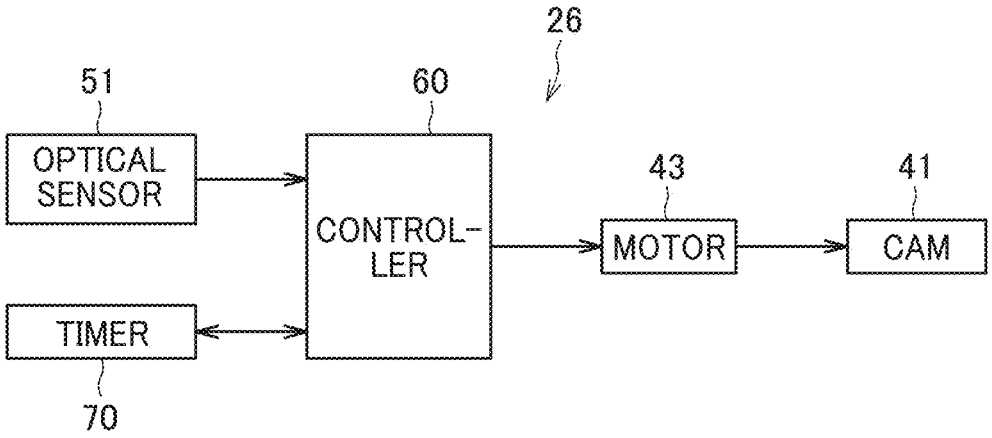
FIG. 6 is a block diagram of a control system of the contact-separation mechanism.

FIG. 2 is a perspective view of the fixing device 5, and FIG. 3 is a side view of the fixing device 5. FIG. 4 is a side view of a contact-separation mechanism 26 included in the fixing device 5, FIG. 5 is a view illustrating a schematic configuration of a drive system of the contact-separation mechanism 26, and FIG. 6 is a block diagram of a control system of the contact-separation mechanism 26.

As illustrated in FIGS. 2 and 3, the fixing device 5 includes a fixing roller 21 as a fixing rotator which fixes an image on a sheet, a pressure roller 22 as a pressure rotator pressurized against the fixing roller 21, a halogen heater 23 as a heater which heats the fixing roller 21, a pair of side plates 24 as supporting members which support the fixing roller 21 and the pressure roller 22, a pressurization mechanism 25 which pressurizes the pressure roller 22 against the fixing roller 21, and a contact-separation mechanism 26 which brings and separates the pressure roller 22 closer to and from the fixing roller 21 as main components.

The pressurization mechanism 25 includes a pressurizing lever 27 as a pressurizing member which pressurizes the pressure roller 22 against the fixing roller 21, and a pressurizing spring 28 as a biasing member which biases the pressurizing lever 27 in a pressurizing direction. One pressurizing lever 27 and one pressurizing spring 28 are provided on each end of the pressure roller 22. One end of the pressurizing lever 27 is attached to a supporting shaft 29 provided at a lower portion of the side plate 24 so as to be swingable in a direction of arrow E in FIG. 3 about the supporting shaft 29. The pressurizing spring 28 is attached between an end of the pressurizing lever 27 on a side opposite to the supporting shaft 29 and an upper portion of the side plate 24. The pressurizing spring 28 biases the pressurizing lever 27 upward in FIG. 3. Since the pressurizing spring 28 biases the pressurizing lever 27 in this manner, the pressure roller 22 is pressed against the fixing roller 21, and a nip portion N is formed between the fixing roller 21 and the pressure roller 22.

The pressure roller 22 is rotationally driven in a direction indicated by arrow B in FIG. 2 or 3 by a drive source provided on an image forming apparatus main body. The fixing roller 21 is driven to rotate in a direction of arrow A in FIG. 2 or 3 as the pressure roller 22 is rotationally driven. In a state in which the fixing roller 21 is heated to predetermined temperature (fixing temperature) by the halogen heater 23 and the fixing roller 21 and the pressure roller 22 rotate, when a sheet carrying an unfixed image is conveyed in a direction of arrow C1 in FIG. 3, the sheet enters the nip portion N, and the sheet is heated and pressurized in the nip portion N. As a result, the unfixed image on the sheet is fixed on the sheet. Thereafter, the sheet is ejected from the nip portion N in a direction of arrow C2 in FIG. 3 by the rotating fixing roller 21 and pressure roller 22.

In the fixing device 5 according to this embodiment, in order to make it easier to remove the sheet when the sheet gets jammed in the nip portion N, or in order to prevent deterioration (creep deformation) due to press of the fixing roller 21 against the pressure roller 22 in a state stopped for a long time, the pressure roller 22 may separate from the fixing roller 21 to reduce a pressurizing force between the rollers. Specifically, as illustrated in FIG. 3, a bearing 30 which rotatably supports each of both the ends of the pressure roller 22 is guided along a bearing guide **24*b* provided on the side plate 24, so that the pressure roller 22 approaches and separates from the fixing roller 21 in a direction of arrow D in the drawing. A bearing 31 which rotatably supports each end of the fixing roller 21 is fitted into a bearing fitting portion 24*a* provided on the side plate 24, and the fixing roller 21** is fixed so as not to move in a direction perpendicular to an axial direction thereof.

The pressure roller 22 is driven by the contact-separation mechanism 26 so as to come closer to/separate from the fixing roller 21. The contact-separation mechanism 26 includes a cam 41 which pushes to move the pressurizing lever 27, a feeler 52 as a detection target which rotates together with the cam 41, and an optical sensor 51 as a detector which detects whether there is the feeler 52 in a detection area L (refer to FIG. 4).

As illustrated in FIG. 2, one cam 41 is provided on each end of a rotation shaft 42 rotatably supported by both the side plates 24. The feeler 52 is fixed to one end of the rotation shaft 42. Therefore, when the rotation shaft 42 rotates, each cam 41 and the feeler 52 rotate together (synchronously).

As illustrated in FIG. 3, the cam 41 includes a cam face 41*a* a distance of which from the rotation center changes in a rotational direction. A cam receiver 32 of the pressurizing lever 27 is in contact with the cam face 41*a* and thus held thereon. As the cam 41 rotates, the pressurizing lever 27 is pushed downward in FIG. 3 or is returned upward in FIG. 3 by the cam face 41*a*. Thus, the pressure roller 22 approaches and separates from the fixing roller 21. Detailed control of a contact-separation operation of the pressure roller 22 is to be described later.

In this embodiment, the cam face 41*a* is provided over a long range in the rotational direction. Specifically, as illustrated in FIG. 4, the cam face 41*a* extends over a range of approximately 270° from a lowest point e1 the closest to the rotation center to a highest point e2 the farthest from the rotation center. Since the cam face 41*a* is provided over the long range in this manner, an incline of the cam face 41*a* from the lowest point e1 to the highest point e2 is gentler than that when the cam face 41*a* is short. This configuration can suppress an increase in torque and generation of operating noise (abnormal noise) when the cam face 41*a* pushes the pressurizing lever 27.

The optical sensor 51 is a transmission-type optical sensor including the detection area L in which a light-emitting element to emit light and a light-receiving element to receive the light emitted from the light-emitting element are arranged. When the feeler 52 rotates, the optical sensor 51 is switched between a light blocked state in which irradiation light in the detection area L is blocked by the feeler 52 and a light transmission state in which the irradiation light is not blocked.

As illustrated in FIG. 4, the feeler 52 includes two light blocking portions 52*a* and 52*b* which block the irradiation light in the detection area L, and two light transmitting portions 52*j* and 52*k* which do not block (which transmit) the irradiation light in the detection area L. One of the light blocking portions 52*a* and 52*b*, the light blocking portion 52*a* is long in the rotational direction (length X1), and the light blocking portion 52*b* is shorter in the rotational direction (length X2) than the light blocking portion 52*a*. One of the light transmitting portions 52*j* and 52*k*, the light transmitting portion 52*k* is long in the rotational direction (length Y1), and the light transmitting portion 52*j* (hole) is shorter in the rotational direction (length Y2) than the light transmitting portion 52*k*.

As illustrated in FIG. 5, the contact-separation mechanism 26 includes, as the drive system, a motor 43 as a drive source and a gear train 44 which transmits a driving force from the motor 43 to the rotation shaft 42. In this embodiment, as the motor 43, a small and inexpensive direct-current (DC) brush motor is used. The gear train 44 includes a first worm gear 45 attached to an output shaft of the motor 43, a second worm gear 46 meshing with the first worm gear 45, a first spur gear 47 as a drive transmission member provided integrally with the second worm gear 46, and a second spur gear 48 as a drive transmission member provided integrally with the feeler 52 so as to mesh (engage) with the first spur gear 47. When the output shaft of the motor 43 rotates, the first and second worm gears 45 and 46 and the first and second spur gears 47 and 48 rotate, and the second spur gear 48 and the feeler 52 rotate integrally, thereby rotating each cam 41 via the rotation shaft 42.

As illustrated in FIG. 6, the contact-separation mechanism 26 includes, as a control system, the optical sensor 51, a controller 60 which controls the rotation of the cam 41, and a timer 70 which measures a rotation time of the cam 41. The controller 60 includes, for example, a central processing unit (CPU), a read only memory (ROM), a random access memory (RAM) and the like provided on the image forming apparatus main body. The controller 60 controls the drive of the motor 43 based on a signal detected by the optical sensor 51 and the time measured by the timer 70 to control the rotation of the cam 41. The controller 60 also controls the timer 70.

Hereinafter, the contact-separation operation of the pressure roller 22 is described.

Depressurizing Operation

Figure 7:
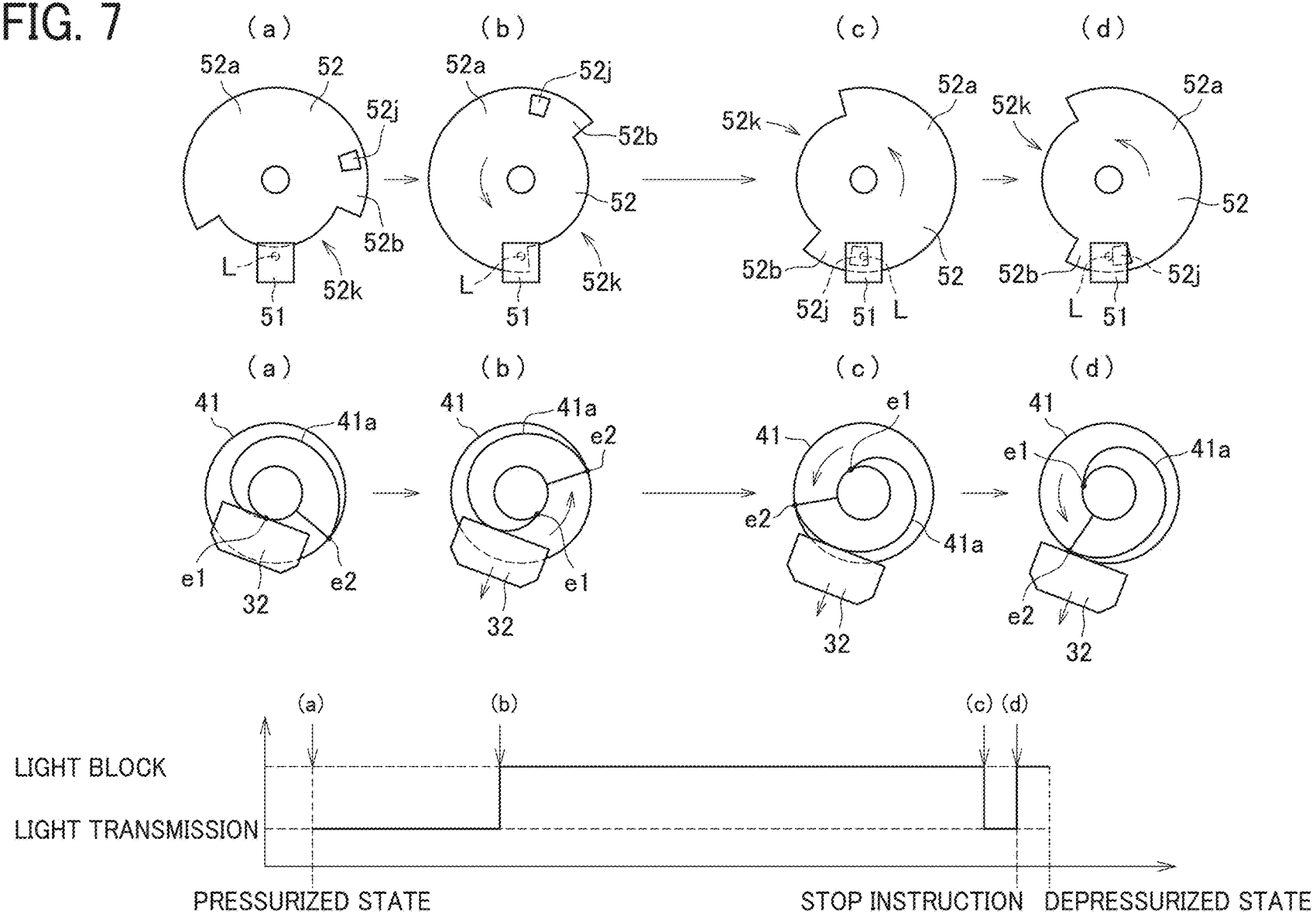
FIG. 7 is a view illustrating a depressurizing operation of the contact-separation mechanism illustrated in FIG. 4.
Figure 8:
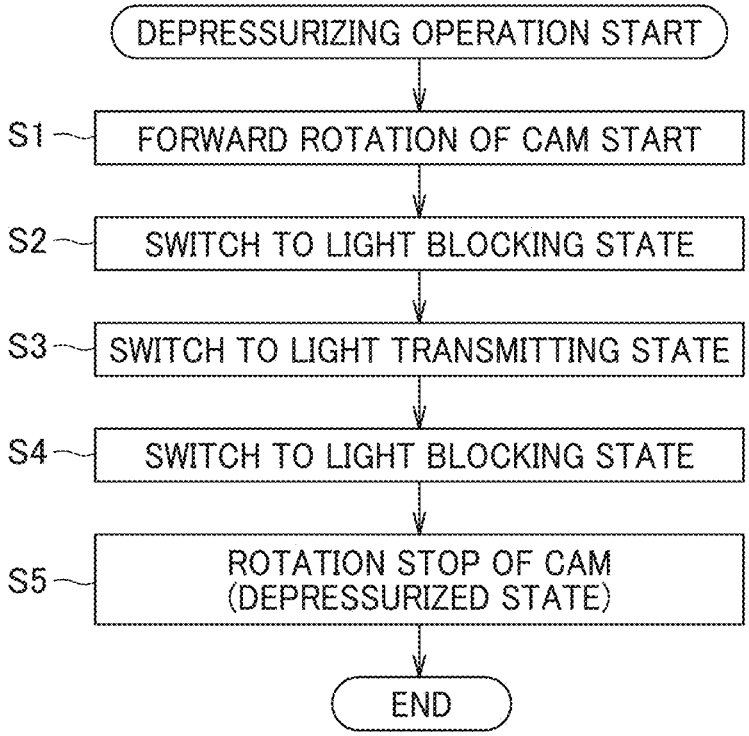
FIG. 8 is a flowchart of the depressurizing operation of the contact-separation mechanism illustrated in FIG. 4.

FIG. 7 is a view illustrating a depressurizing operation from a pressurized state (close state) in which the pressure roller 22 is pressurized against the fixing roller 21 with a normal pressurizing force to a depressurized state (separate state) in which the pressurizing force becomes smaller than a normal force, and FIG. 8 is a flowchart of the depressurizing operation. The depressurized state may be a state in which the pressure roller 22 is completely separated from the fixing roller 21 to be a non-contact state or may be a state in which the pressure roller 22 is in contact with the fixing roller 21 but a relative axial distance therebetween increases and the pressurizing force decreases. In FIG. 7, (a) to (d) on an upper stage illustrate a rotating operation of the feeler 52, (a) to (d) on a middle stage illustrate a rotating operation of the cam 41, and (a) to (d) on a lower stage illustrate a timing chart of light transmission and light blocking of the optical sensor 51. In FIG. 7, (a) to (d) on the upper, middle, and lower stages correspond to one another.

In the pressurized state illustrated in (a) of FIG. 7, the pressurizing lever 27 (cam receiver 32) comes into contact with the cam face 41*a* on the lowest point e1 side, and the pressure roller 22 comes closer to the fixing roller 21. At that time, the feeler 52 does not block light in the detection area L of the optical sensor 51 and is in a light transmission state.

When the cam 41 is rotated counterclockwise (in a forward direction) in FIG. 7 from this state (S1 in FIG. 8), the long light blocking portion 52*a* of the feeler 52 reaches the detection area L as illustrated in (b) of FIG. 7, so that the optical sensor 51 is switched to the light blocked state (S2 in FIG. 8).

Thereafter, the rotation of the cam 41 is continued and the long light blocking portion 52*a* of the feeler 52 passes through the detection area L as illustrated in (c) of FIG. 7 (the short light transmitting portion 52*j* reaches the detection area L), so that the optical sensor 51 is switched from the light blocked state to the light transmission state (S3 in FIG. 8).

Thereafter, the short light transmitting portion 52*j* of the feeler 52 passes through the detection area L, so that the short light blocking portion 52*b* reaches the detection area L as illustrated in (d) of FIG. 7 and the optical sensor 51 is switched again from the light transmission state to the light blocked state (S4 in FIG. 8). At a timing of switching to the light blocked state, an instruction to stop the cam 41 is issued from the controller 60. As a result, the rotation of the cam 41 is completely stopped and pressure roller 22 becomes the depressurized state (S5 in FIG. 8). In the depressurized state, the pressurizing lever 27 comes into contact with the cam face 41*a* on the highest point e2 side, and the pressure roller 22 is held in a state separated from the fixing roller 21.

Pressurizing Operation

Subsequently, a pressurizing operation from the depressurized state to the pressurized state is described with reference to FIGS. 9 and 10.

Figure 9:
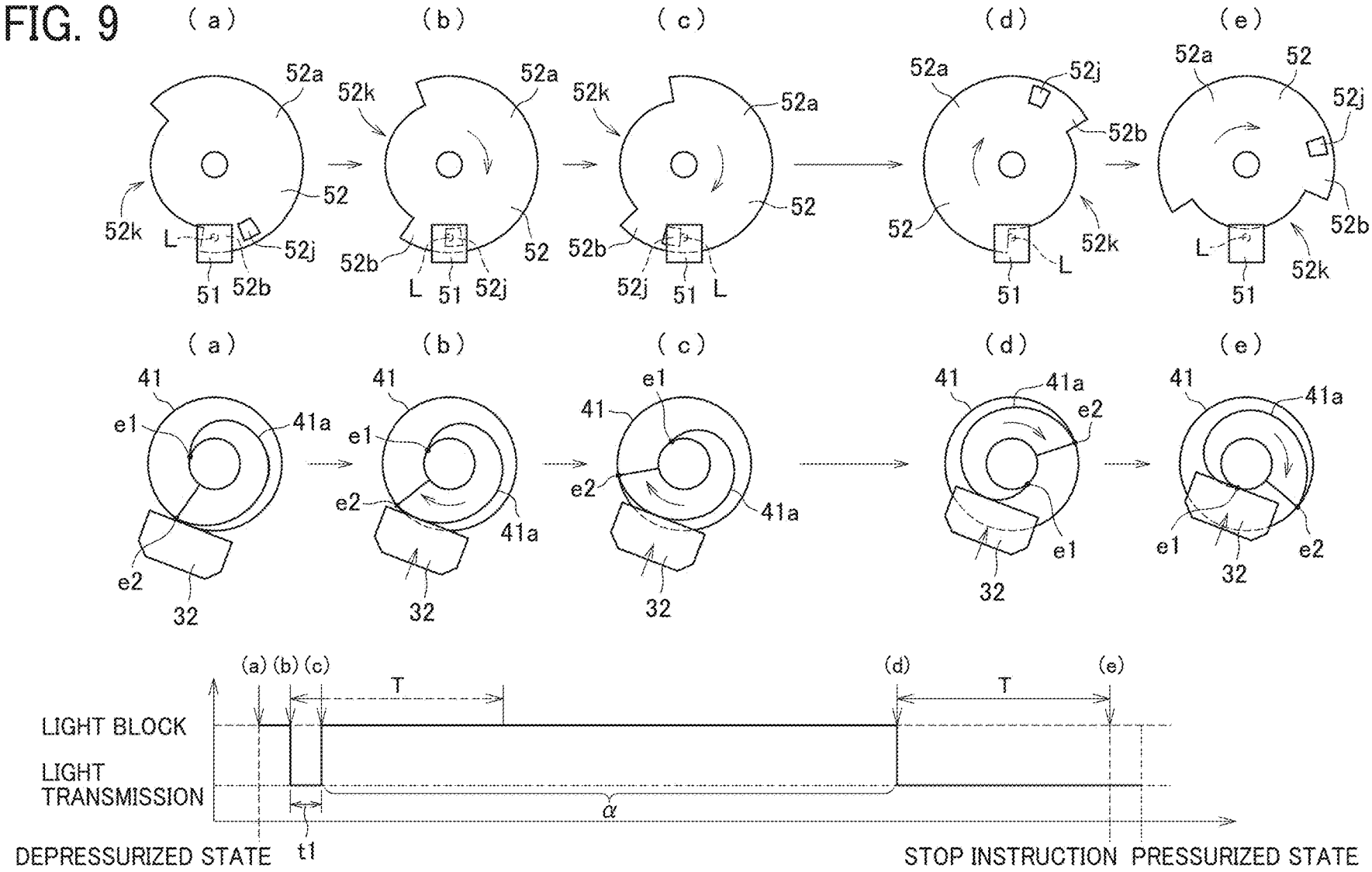
FIG. 9 is a view illustrating a pressurizing operation of the contact-separation mechanism illustrated in FIG. 4.

In FIG. 9 also, as in FIG. 7, the rotating operation of the feeler 52 is illustrated on an upper stage, the rotating operation of the cam 41 is illustrated on a middle stage, and a timing chart of light transmission and light blocking of the optical sensor 51 is illustrated on a lower stage. Note that (a) to (e) on the upper, middle, and lower stages correspond to one another.

In the depressurized state illustrated in (a) of FIG. 9, the short light blocking portion 52*b* of the feeler 52 overlaps with the detection area L of the optical sensor 51, and the optical sensor 51 is in the light blocked state. When changing from the depressurized state to the pressurized state, the cam 41 is rotated in a direction opposite to that when changing from the pressurized state to the depressurized state described above (S11 in FIG. 10).

Figure 10:
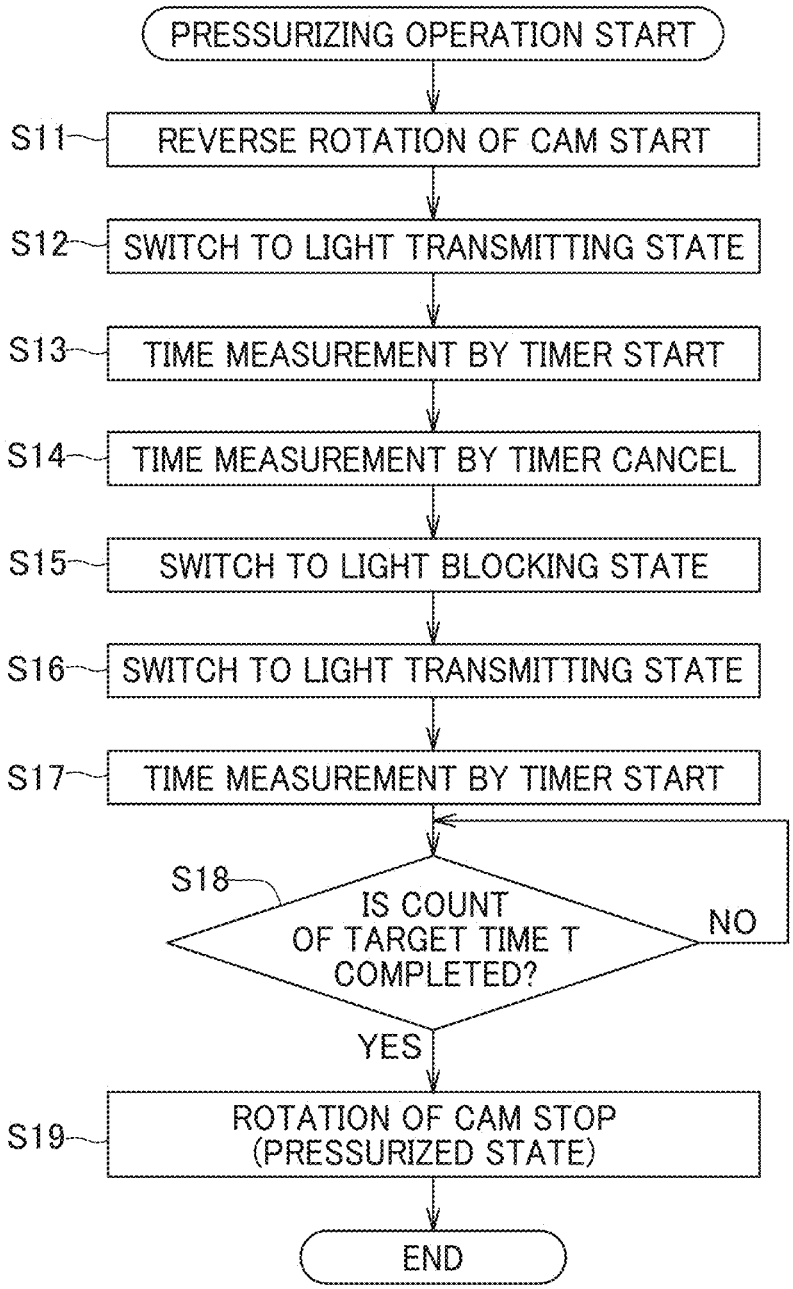
FIG. 10 is a flowchart of the pressurizing operation.

When the cam 41 is rotated clockwise (in a reverse direction) in FIG. 9, the short light blocking portion 52*b* of the feeler 52 passes through the detection area L as illustrated in (b) of FIG. 9 (the short light transmitting portion 52*j* reaches the detection area L), so that the optical sensor 51 is switched from the light blocked state to the light transmission state (S12 in FIG. 10).

At a timing at which the optical sensor 51 is switched to the light transmission state, time measurement by the timer 70 is started (S13 in FIG. 10). The time measurement by the timer 70 is performed as long as the light transmission state of the optical sensor 51 continues, and when the measurement (counting) of a target time T by the timer 70 is completed, the instruction to stop the rotation of the cam 41 is issued from the controller 60. However, a light transmitting time (passing time of the short light transmitting portion 52*j*) t1 after the optical sensor 51 becomes the light transmission state illustrated in (b) of FIG. 9 to the switching to the light blocked state illustrated in (c) of FIG. 9 thereafter is set to be shorter than the target time T measured by the timer 70. Therefore, herein, since the optical sensor 51 switches to the light blocked state before the timer 70 completes the measurement of the target time T, the time measurement by the timer 70 is canceled halfway (S14 in FIG. 10). As a result, the rotation of the cam 41 is continued without being stopped.

Thereafter, after the optical sensor 51 becomes the light blocked state illustrated in (c) of FIG. 9 (S15 in FIG. 10), the long light blocking portion 52*a* passes through the detection area L as illustrated in (d) of FIG. 9 (the long light transmitting portion 52*k* reaches the detection area L), so that the optical sensor 51 is switched again from the light blocked state to the light transmission state (S16 in FIG. 10). Then, at the timing of switching to the light transmission state, the time measurement by the timer 70 is started again (S17 in FIG. 10). In this case also, the time measurement by the timer 70 is performed as long as the light transmission state of the optical sensor 51 continues. Here, since the light transmitting time during which the long light transmitting portion 52*k* passes through the detection area L is much longer than the light transmitting time with the short light transmitting portion 52*j* described above, the light transmitting time continues until the timer 70 completes measuring the target time T.

As a result, as illustrated in (e) of FIG. 9, the time measurement by the timer 70 is completed without being canceled halfway (S18 in FIG. 10). Then, at the timing when the measurement of the target time T is completed, the instruction to stop the cam 41 is issued. Upon receiving this stop instruction, the motor stops driving, the rotation of the cam 41 is completely stopped, and the pressure roller 22 becomes the pressurized state (S19 in FIG. 10).

Initializing Operation

In the fixing device according to this embodiment, an initializing operation of returning a rotational phase of the cam 41 to a predetermined rotational phase so that the pressure roller 22 enters the pressurized state is performed each time the image forming apparatus is powered on.

For example, when the fixing device does not stop after a normal finishing operation such as when the image forming apparatus is forcibly stopped due to abnormality, the rotation of the cam 41 may stop between the pressurized state and the depressurized state. Thereafter, when the image forming apparatus is powered on, the controller 60 determines whether the optical sensor 51 is in the light transmission state or the light blocked state. However, to correctly grasp the rotational phase of the cam 41, it is necessary to determine whether the optical sensor 51 is in the light transmission state or the light blocked state. Therefore, in the fixing device according to this embodiment, when the image forming apparatus is powered on, the initializing operation is performed to return the rotational phase of the cam 41 to the predetermined rotational phase.

Hereinafter, the initializing operation is described.

The initializing operation includes a first initializing operation which starts when the optical sensor 51 is in the light transmission state when the image forming apparatus is powered on, and a second initializing operation which starts when the optical sensor 51 is in the light blocked state on the contrary. When the optical sensor 51 is in the light transmission state when the image forming apparatus is powered on, the first initializing operation is first performed so that the optical sensor 51 is temporarily shifted from the light transmission state to the light blocked state, then, the second initializing operation is performed. In contrast, when the optical sensor 51 is in the light blocked state when the image forming apparatus is powered on, the first initializing operation is not performed and the second initializing operation is performed. In either case, since the second initializing operation is always performed, the optical sensor 51 is shifted from the light blocked state to a specific light transmission state, so that the cam 41 is returned to the predetermined rotational phase.

The first initializing operation is first described.

The first initializing operation is performed when the optical sensor 51 is in the light transmission state when the image forming apparatus is powered on. In this embodiment, the light transmission state includes a case in which the short light transmitting portion 52*j* of the feeler 52 overlaps with the detection area L illustrated in (a) of FIG. 11, and a case in which the long light transmitting portion 52*k* overlaps with the detection area L illustrated in (a) of FIG. 12. In either case, the first initializing operation is performed with the same flow illustrated in FIG. 13.

Figure 11:
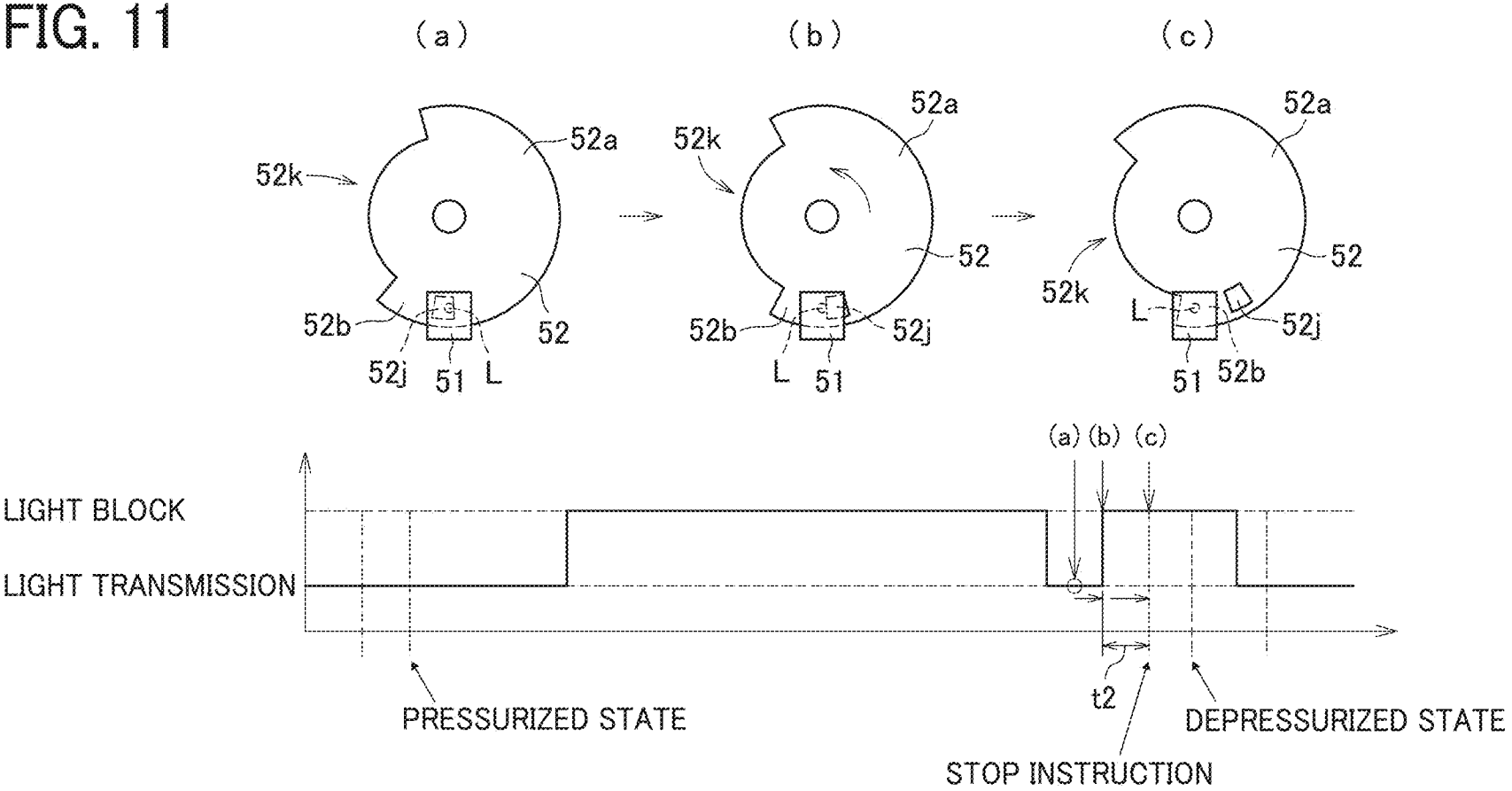
FIG. 11 is a view illustrating a first initializing operation of the fixing device.
Figure 12:
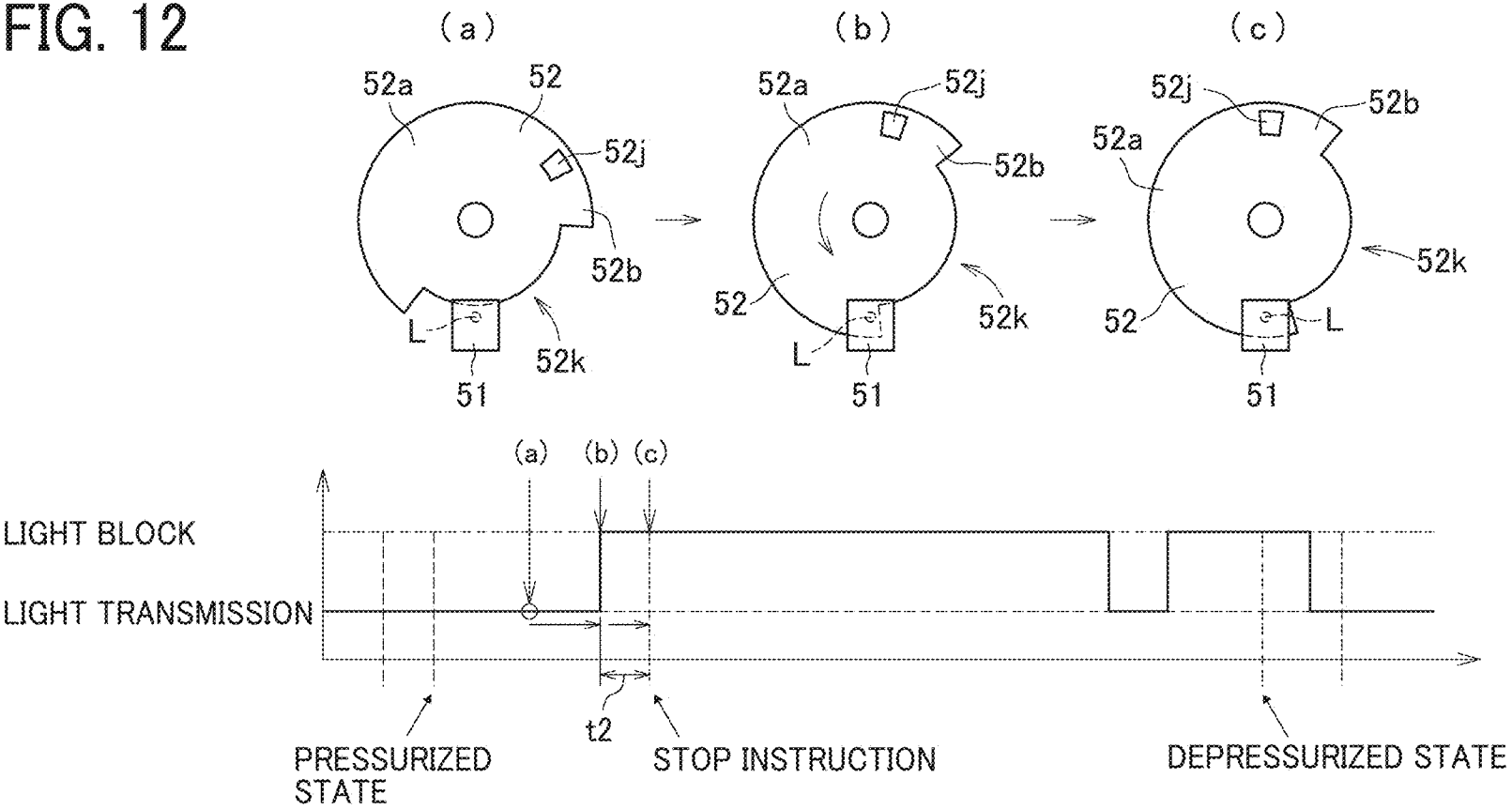
FIG. 12 is a view illustrating the first initializing operation.

In FIGS. 11 and 12, (a) to (c) on an upper stage illustrate the rotating operation of the feeler 52, and (a) to (c) on a lower stage illustrate a timing chart of light transmission and light blocking of the optical sensor 51. In FIGS. 11 and 12, (a) to (c) on the upper and lower stages correspond to one another.

In both of the cases illustrated in FIGS. 11 and 12, the controller 60 confirms that the optical sensor 51 is in the light transmission state when the image forming apparatus is powered on, but the rotational phase of the feeler 52 is different therebetween, so that positions of an initializing operation starting point (a) are different. However, in either case, the cam 41 is first rotated in a direction to shift to the depressurized state (forward direction) (S1 in FIG. 13).

Figure 13:
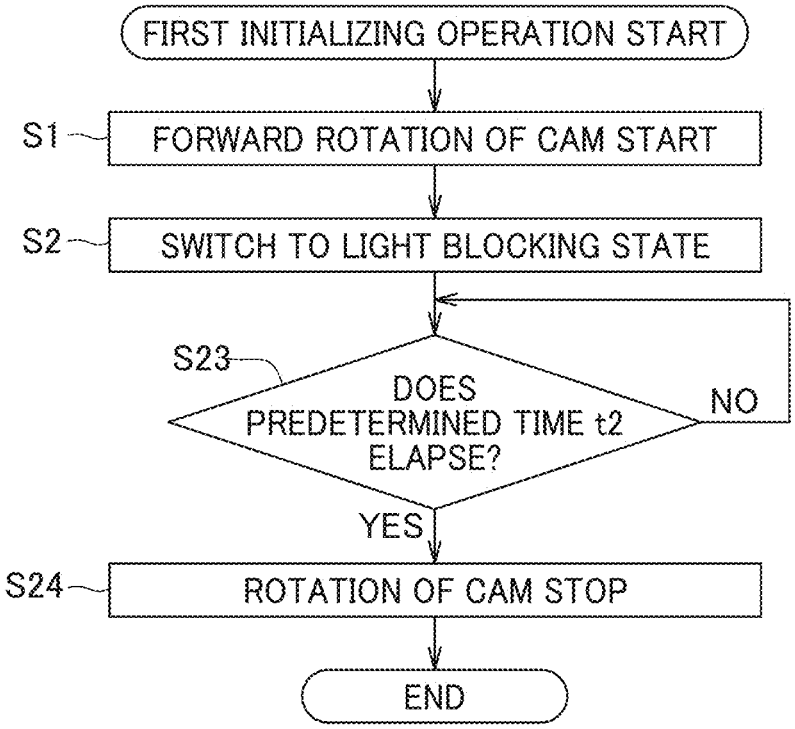
FIG. 13 is a flowchart of the first initializing operation.

When the cam 41 is rotated in the direction to shift to the depressurized state, the optical sensor 51 is switched to the light blocked state as illustrated in (b) of FIGS. 11 and 12 (S2 in FIG. 13). When a predetermined time t2 elapses from a time point (b) (S23 in FIG. 13), the instruction to stop the rotation of the cam 41 is issued, and the rotation of the cam 41 is stopped (S2 4 in FIG. 13). The predetermined time t2 is set to a time from the time point (b) when the optical sensor 51 is switched to the light blocked state, the time during which the cam 41 does not exceed a position of the depressurized state, in particular, in the case illustrated in FIG. 11. As a result, in each case, the optical sensor 51 enters the light blocked state, and the first initializing operation is completed.

Next, the second initializing operation is described.

Figure 14:
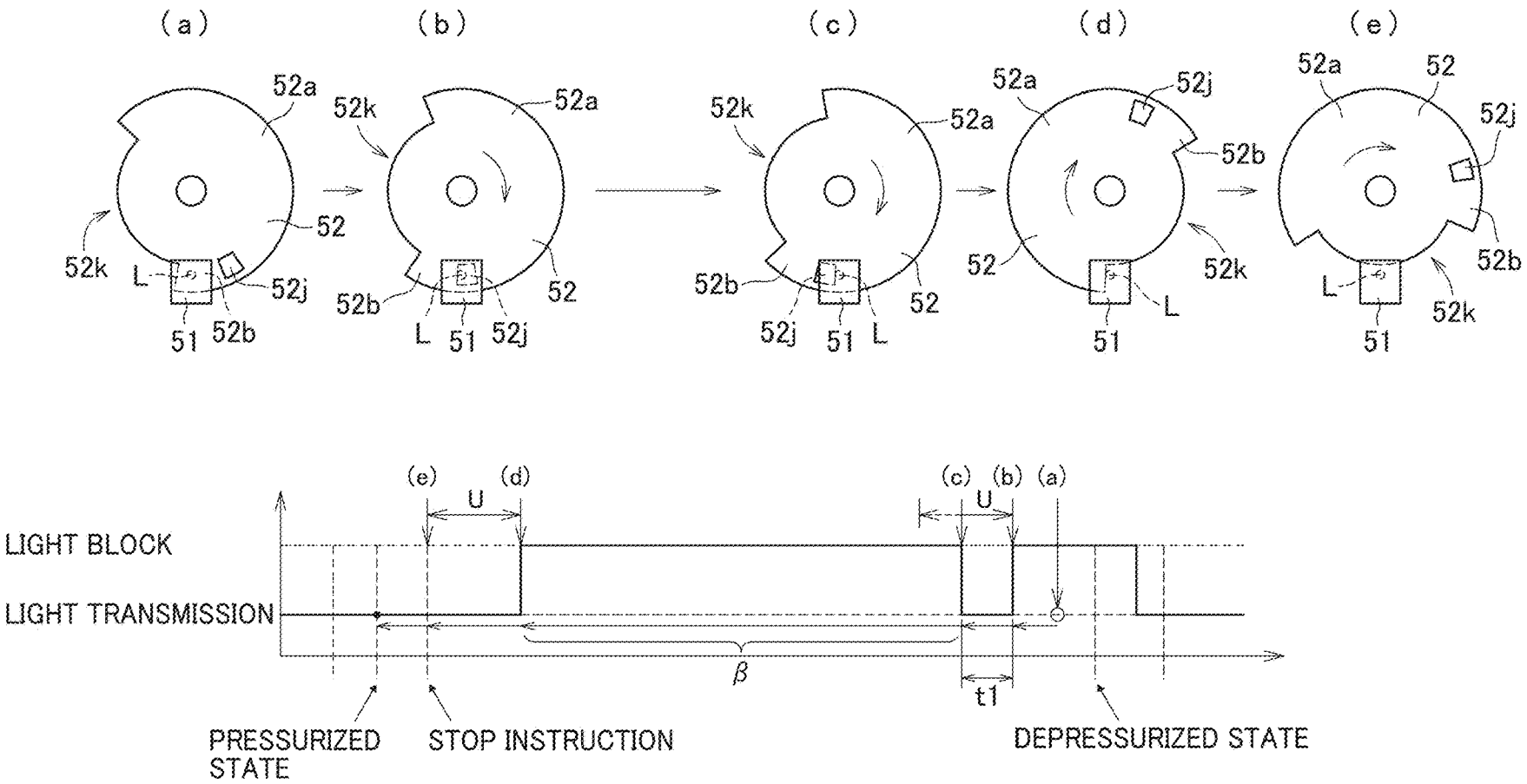
FIG. 14 is a view illustrating a second initializing operation of the fixing device.
Figure 15:
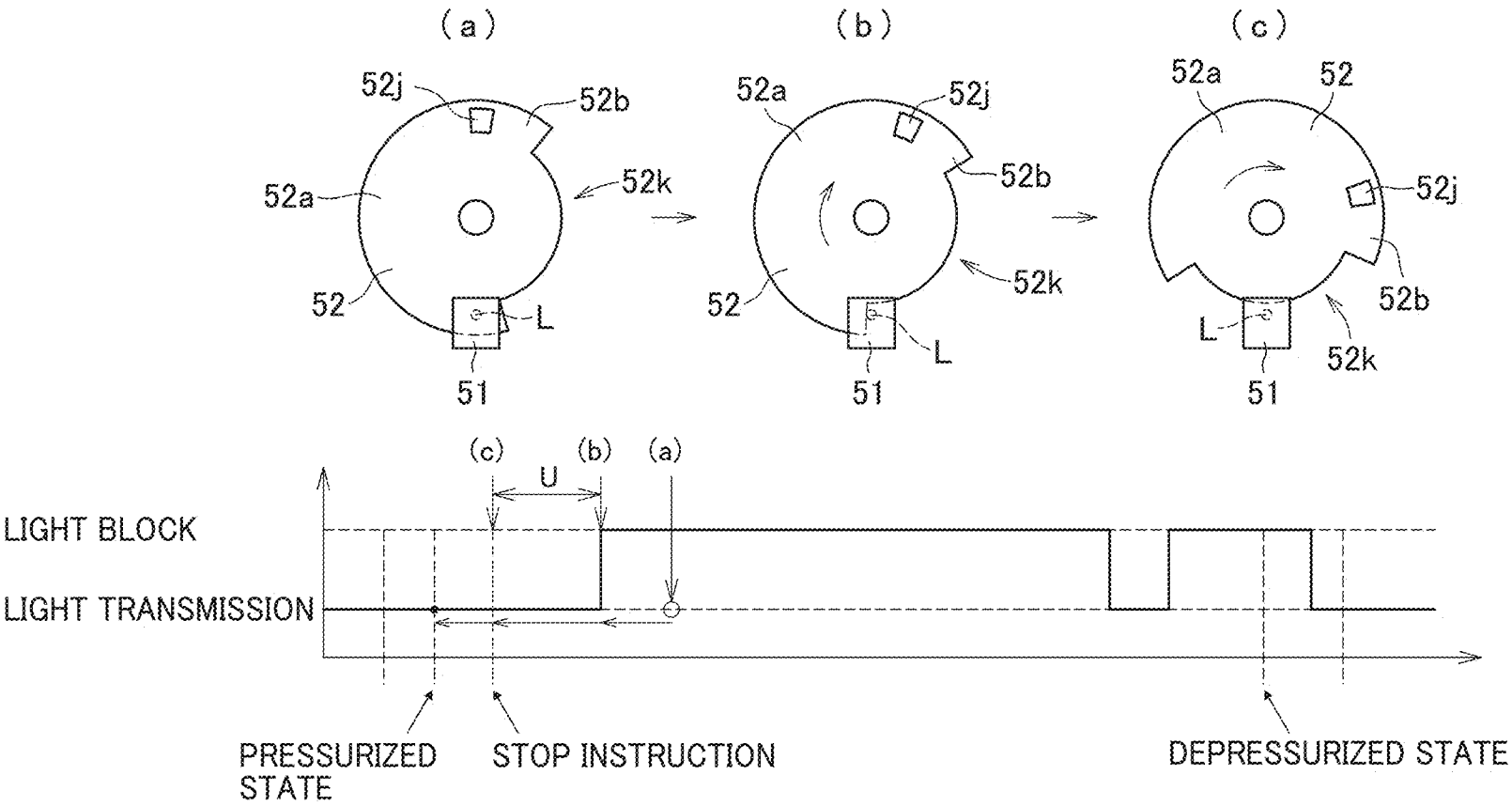
FIG. 15 is a view illustrating the second initializing operation.

The rotating operation of the feeler 52 when performing the second initializing operation, and a timing chart of light transmission and light blocking of the optical sensor 51 are illustrated on upper and lower stages in FIGS. 14 and 15, respectively. FIG. 14 illustrates an operation continued from the first initializing operation illustrated in FIG. 11, and FIG. 15 illustrates an operation continued from the first initializing operation illustrated in FIG. 12. Note that (a) to (e) on the upper and lower stages in FIG. 14 and (a) to (c) on the upper and lower stages in FIG. 15 correspond to one another. In either case in FIGS. 14 and 15, the second initializing operation is performed with the same flow illustrated in FIG. 16.

Figure 16:
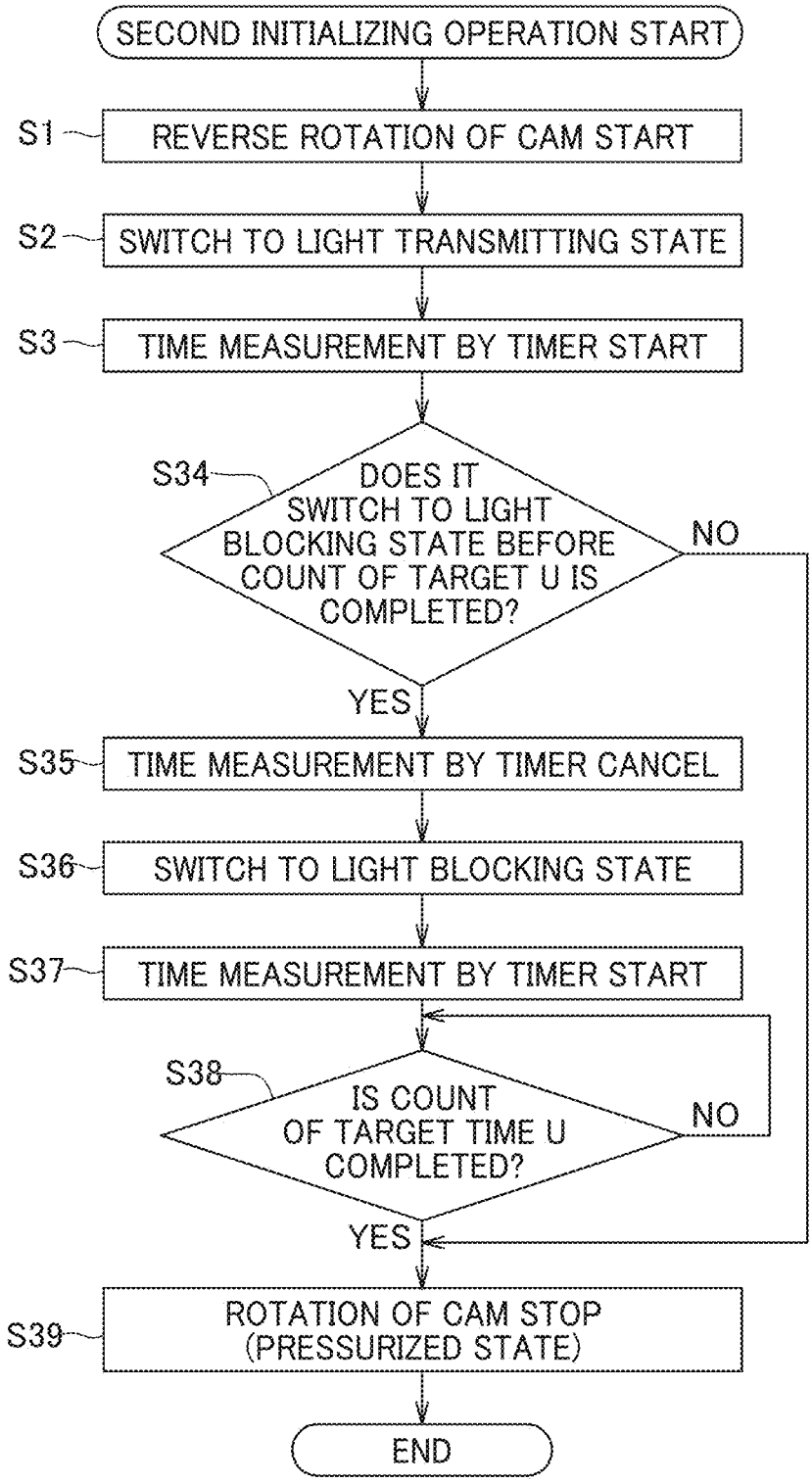
FIG. 16 is a flowchart of the second initializing operation.

In the second initializing operation, when it is confirmed that the optical sensor 51 is in the light blocked state, in either case of FIGS. 14 and 15, the cam 41 is first rotated in the direction to shift to the pressurized state (reverse direction) (S11 in FIG. 16). When the cam 41 is rotated in the direction to shift to the pressurized state, the optical sensor 51 is switched to the light transmission state as illustrated in (b) of FIGS. 14 and 15 (S12 in FIG. 16). From that time point, the time measurement by the timer 70 is started (S13 in FIG. 16).

The time measurement by the timer 70 is performed as long as the light transmission state of the optical sensor 51 continues (S34 in FIG. 16). However, a target time U measured by the timer 70 at that time is set to be longer than a time t1 during which the short light transmitting portion 52*j* passes through the detection area L (refer to FIG. 14). Therefore, in the case in FIG. 14, since the optical sensor 51 is switched to the light blocked state illustrated in (c) of FIG. 14 before the measurement of the target time U by the timer 70 is completed, the time measurement by the timer 70 is canceled halfway (S35 in FIG. 16). In contrast, in the case of FIG. 15, the long light transmitting portion 52*k* longer than the short light transmitting portion 52*j* passes through the detection area L, so that the measurement of the target time U by the timer 70 is completed without being canceled halfway. In the case of FIG. 15, the instruction to stop the cam 41 is issued at the timing when the measurement of the target time U by the timer 70 is completed, and the rotation of the cam 41 is stopped (S39 in FIG. 16). As a result, the rotational phase of the cam 41 becomes the predetermined rotational phase, the pressure roller 22 enters the pressurized state, and the second initializing operation is completed.

In contrast, in the case of FIG. 14, after the measurement of the target time U by the timer 70 is canceled, the long light blocking portion 52*a* passes through the detection area L (the long light transmitting portion 52*k* reaches the detection area L), so that, as illustrated in (d) of FIG. 14, the optical sensor 51 is switched again to the light transmission state (S36 in FIG. 16). From that time point, the measurement of the target time U by the timer 70 is started again (S37 in FIG. 16). In this case, the long light transmitting portion 52*k* longer than the short light transmitting portion 52*j* passes through the detection area L, so that the measurement of the target time U by the timer 70 is completed without being canceled halfway (S38 in FIG. 16). Then, the instruction to stop the cam 41 is issued at the timing when the measurement of the target time U by the timer 70 is completed, and the rotation of the cam 41 is stopped (S39 in FIG. 16). As a result, also in the case of FIG. 14, the rotational phase of the cam 41 becomes the predetermined rotational phase, the pressure roller 22 enters the pressurized state, and the second initializing operation is completed.

As described above, when the optical sensor 51 is in the light transmission state when the power is on, by performing the second initializing operation after performing the first initializing operation, the rotational phase of the cam 41 may be returned to the predetermined rotational phase and the pressure roller 22 may enter the pressurized state also when the cam 41 stops at an arbitrary rotational phase.

When the optical sensor 51 is in the light blocked state at the time of power on, the first initializing operation is not performed and the second initializing operation is performed. A procedure of the second initializing operation in this case is similar to that of the second initializing operation described above. As a result, the rotational phase of the cam 41 can be returned to the predetermined rotational phase, and the pressure roller 22 can be made in the pressurized state.

As a drive source which rotationally drives the cam 41, for example, a small and inexpensive DC motor (DC brush motor or DC brushless motor) may be used. However, the DC motor has a characteristic that a rotational speed changes according to magnitude of torque (load). Therefore, when the DC motor is used as the drive source of the cam 41, if a stop timing of the cam 41 is controlled based on the rotational speed of the DC motor (time), the rotational speed of the DC motor changes according to the magnitude of the torque, so that a rotation stop position of the cam 41 may vary. If the rotation stop position of the cam 41 varies, there is a case in which a desired pressurized state or depressurized state is not obtained, and a fixing quality is not maintained satisfactorily. Such variation in the rotation stop position is caused by various factors such as circumstances inherent to the motor at the time of manufacturing, deterioration over time of parts, changes in installation environment of the device, and replacement of a unit device in addition to the torque generated in the motor. Such a problem is not limited to the case where the DC motor is used as the drive source of the cam, but may also occur similarly when another drive source a rotational speed of which changes due to various circumstances is used.

Therefore, in the fixing device according to this embodiment, in order to suppress the variation in the rotation stop position of the cam 41 as described above, a motor drive time for rotating the cam 41 is corrected.

Correction of Motor Drive Time

The controller 60 illustrated in FIG. 6 corrects the motor drive time. The controller 60 corrects the drive time of the motor 43 based on a duration of passing of a reference range of the feeler 52 through the detection area L of the optical sensor 51. When a rotational speed of the cam 41 changes due to variation in the rotational speed of the motor 43, a rotational speed of the feeler 52 which rotates together with the cam 41 also changes. Therefore, by measuring the time during which the reference range of the feeler 52 passes through the detection area L of the optical sensor 51, the controller 60 can determine whether the cam 41 rotates at a speed higher or lower than a predetermined rotational speed. Therefore, in this embodiment, by changing the motor drive time based on a passing time of the feeler 52, the drive time is adjusted according to the change in the rotational speed of the cam 41. For example, when the passing time of the feeler 52 is shorter than a reference value, the controller 60 determines that the rotation speed of the cam 41 is higher than the predetermined rotational speed. Therefore, the controller 60 can shorten the motor drive time to the stop of the cam 41, thereby stopping the cam 41 at an appropriate position. In vcontrast, when the passing time of the feeler 52 is longer than the reference value, the controller 60 determines that the rotational speed of the cam 41 is lower than the predetermined rotational speed. Therefore, the controller 60 can elongate the motor drive time to the stop of the cam 41.

In this embodiment, the motor drive time is corrected at the time of the pressurizing operation illustrated in FIG. 9 and the second initializing operation illustrated in FIG. 14.

First, the correction of the motor drive time performed at the time of the pressurizing operation is described.

In the correction control of the motor drive time performed at the time of the pressurizing operation, the controller 60 measures the duration a from when optical sensor 51 enters the light blocked state illustrated in (c) of FIG. 9 until optical sensor 51 enters the light transmission state illustrated in (d) of FIG. 9, that is, during which the long light blocking portion 52*a* of the feeler 52 passes through the detection area L of the optical sensor 51. Then, the controller 60 compares the measured duration a of passing of the long light blocking portion 52*a* with a reference value set in advance, and corrects the target time T measured by the timer 70, from when optical sensor 51 enters the light transmission state illustrated in (d) of FIG. 9 until the rotation stop instruction illustrated in (e) of FIG. 9 is issued based on the result. For example, when the measured passing time of the long light blocking portion 52*a* is shorter than the reference value, the target time T is shortened. In contrast, when the passing time of the long light blocking portion 52*a* is longer than the reference value, the target time T is elongated.

The following advantage is available by correcting the target time T based on the measured passing time of the long light blocking portion 52*a* and issuing the rotation stop instruction of the cam 41 based on the corrected target time T in this manner. Even if the rotational speed of the cam 41 changes, variations in the rotation stop position caused by such changes are minimized.

Next, the correction of the motor drive time performed at the time of the second initializing operation is described.

In the correction control of the motor drive time performed at the time of the second initializing operation, the controller 60 measures a time β from when optical sensor 51 enters the light blocked state illustrated in (c) of FIG. 14 until optical sensor 51 enters the light transmission state illustrated in (d) of FIG. 14 during which the long light blocking portion a of the feeler 52 passes through the detection area L of the optical sensor 51. Then, the controller 60 compares the measured long light blocking portion 52*a* passing time with a reference value set in advance, and corrects the target time U measured by the timer 70 from when optical sensor 51 enters the light transmission state illustrated in (d) of FIG. 14 until the rotation stop instruction illustrated in (e) of FIG. 14 is issued based on the result. In this case also, when the measured passing time of the long light blocking portion 52*a* is shorter than the reference value, the target time U is shortened. In contrast, when the passing time of the long light blocking portion 52*a* is longer than the reference value, the target time U is elongated.

The following advantage is available by correcting the target time U based on the measured passing time of the long light blocking portion 52*a* and issuing the rotation stop instruction of the cam 41 based on the corrected target time U as at the time of the pressurizing operation also at the time of the second initializing operation in this manner. Even if the rotational speed of the cam 41 changes, variations in the rotation stop position can be minimized.

As described above, in this embodiment, by setting (correcting) the target times T and U of the timer 70 for issuing the rotation stop instruction of the cam 41 at the time of the pressurizing operation and the second initialization operation based on the time during which the long light blocking portion 52*a* passes through the detection area L, it is possible to suppress the variation in the rotation stop position caused by change in the rotational speed of the cam 41, and to stop the cam 41 at the appropriate position. Setting (correcting) such target times T and U based on the duration of an immediately preceding passing of the long light blocking portion 52*a* through the detection area L can improve accuracy of the rotation stop position of the cam 41. That is, the target times T and U for immediately subsequent measurement thereof are set (corrected) each time the long light blocking portion 52*a* passes. Therefore, even if the rotational speed of the cam 41 changes immediately before the rotation stop instruction of the cam 41 is issued, the target times T and U can be set accordingly. Therefore, the rotation of the cam 41 can be controlled corresponding not only to predetermined variation such as the rotational speed inherent to the motor but also to variation which changes sequentially such as a change in installation environment of the device or replacement of the unit device. By improving the rotation stop position accuracy of the cam 41, an inexpensive DC motor (DC brush motor or DC brushless motor) may be used as the drive source of the cam 41 to realize a low cost.

In this embodiment, at the time of the depressurizing operation, as at the time of the pressurizing operation and the second initializing operation, the long light blocking portion 52*a* passes through the detection area L {shift from (b) to (c) of FIG. 7}, the passing time of the long light blocking portion 52*a* at that time is not measured. This is because the rotation stop instruction of the cam 41 at the time of the depressurizing operation is not determined based on the timing of the time measurement by the timer 70, but is determined based on a detection timing of the feeler 52 by the optical sensor 51 unlike the time of the pressurizing operation or the second initializing operation. That is, even if the rotational speed of the cam 41 changes, the detection timing of the feeler 52 by the optical sensor 51 is not affected by this. Therefore, measuring the passing time of the long light blocking portion 52*a* at the time of the depressurizing operation is not required, and the cam 41 can be stopped at an appropriate rotation stop position (depressurized position) without measuring the passing time of the long light blocking portion 52*a*.

In contrast, at the time of the pressurizing operation and the second initializing operation, the rotation stop position of the cam 41 is managed based on the timing of the time measurement by the timer 70 easily affected by the change in the rotational speed of the motor, so that it is possible to suppress the variation in the rotation stop position of the cam 41 by setting the timer target time based on the passing time of the long light blocking portion 52*a*.

Here, unlike this embodiment, it is also possible to control the rotation stop position of the cam 41 at the time of the pressurizing operation or the second initializing operation based on the detection timing of the feeler 52 by the optical sensor 51 which is not affected by the rotational speed of the motor in place of the timer 70. However, in that case, a separate optical sensor is necessary for detecting the rotational position of the cam at the time of the depressurizing operation, and another optical sensor is required for detecting the rotational position of the cam at the time of the pressurizing operation. Therefore, a new disadvantage such as an increase in the number of optical sensors, a high cost, and a large-sized device arises.

In contrast, in this embodiment, the rotation of the cam 41 at the time of the depressurizing operation is stopped based on the detection timing of the feeler 52 by the optical sensor 51, and the rotation of the cam 41 at the time of the pressurizing operation is stopped based on the timing of the time measurement by the timer 70. Therefore, one of the optical sensors may be omitted, so that a cost and a size may be made smaller than those when two optical sensors are provided.

As described above, according to the contact-separation mechanism according to the present disclosure, in the fixing device in which one of control at the time of the pressurizing operation and that at the time of the depressurizing operation is performed by the time measurement by the timer, thereby omitting one of the optical sensors in order to realize the low cost and the compact size, it is possible to reduce the variation in the rotation stop position of the cam 41 at the time of the pressurizing operation and the depressurizing operation, and to improve the positional accuracy.

In the above-described embodiment, the timing of the rotation stop instruction of the cam 41 at the time of the depressurizing operation {(d) of FIG. 7} is determined based on the detection timing of the feeler 52 by the optical sensor 51; however, it is also possible to issue the rotation stop instruction of the cam 41 after the time measurement by the timer 70 after the optical sensor 51 detects an edge (light transmitting unit or light blocking portion) of the feeler 52. However, in this case, desirably, the time (target time) measured by the timer 70 is made shorter than the target time T measured by the timer 70 at the time of the pressurizing operation. The longer the timer measurement time, the greater the variation, so that by making the timer measurement time at the time of the depressurizing operation shorter than the timer measurement time at the time of the pressurizing operation, the variation in the timer measurement time at the time of the depressurizing operation is suppressed, and the cam 41 may be stopped accurately to a certain degree without correcting the target time based on the passing time of the feeler 52 as described above.

In the above-described embodiment, the rotation of the cam 41 is stopped based on the detection timing of the feeler 52 by the optical sensor 51 at the time of the depressurizing operation, and the rotation of the cam 41 is stopped based on the timing of the time measurement by the timer 70 at the time of the pressurizing operation. However, the control may be switched between the depressurizing operation and the pressurizing operation. That is, the timer target time may be set based on the passing time of the long light blocking portion 52*a* described above not at the time of the pressurizing operation but at the time of the depressurizing operation. The reference range of the feeler 52 measured in order to set the timer target time is not necessarily the long light blocking portion 52*a*. The reference range of the feeler 52 may be arbitrarily set as long as this is the range which passes through the detection area L immediately before the time measurement by the timer 70 for issuing the rotation stop instruction of the cam 41. The reference range of the feeler 52 may be the light transmitting unit which transmits the light instead of the light blocking portion which blocks the light of the optical sensor 51.

The contact-separation mechanism according to the present disclosure is not limited to the fixing device including a pair of rollers (fixing roller and pressure roller) as in the above-described embodiment. For example, this may be a fixing device including an endless fixing belt instead of the fixing roller. The contact-separation mechanism according to the present disclosure is further applicable to the fixing device in which the fixing roller approaches and separates from the pressure roller in place of the fixing device in which the pressure roller approaches and separates from the fixing roller as in the above-described embodiment.

An aspect of the present disclosure is applicable not only to the fixing device but also to other contact-separation mechanisms which move a contact-separation member closer to and from a counterpart member. For example, the present disclosure is also applicable to a contact-separation mechanism which brings and separates a transfer roller 15 closer to and from the photoconductor 7 in an image forming apparatus of a direct transfer type as illustrated in FIG. 1, or a contact-separation mechanism which brings and separates a secondary transfer roller closer to and from an intermediate transfer belt in an image forming apparatus of an indirect transfer type.

Figure 17:
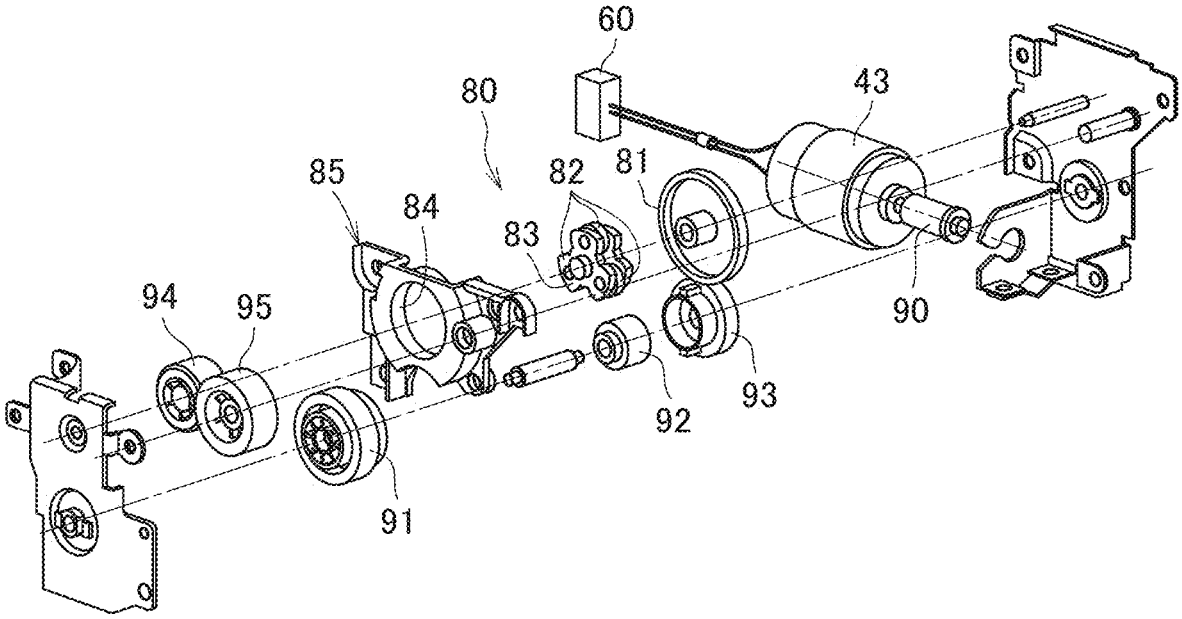
FIG. 17 is an exploded view of a drive system according to another embodiment.

FIG. 17 illustrates an exploded view of a drive system different from the above-described embodiment.

The drive system of the contact-separation mechanism illustrated in FIG. 17 includes a speed reducer 80 which transmits the driving force from the motor 43 to the cam 41 at a reduced speed. The speed reducer 80 is a planetary gear reducer which includes a sun gear 81, a plurality of planetary gears 82, a planetary carrier 83 which holds the planetary gears 82, and a housing 85 in which an internal gear 84 is formed. The sun gear 81 is connected to a worm gear 90 provided on the rotation shaft of the motor 43 via a worm wheel 91 which meshes with the same, and a torque limiter 92 and a torque limiter gear 93 assembled to the worm wheel 91. When the driving force of the motor 43 is transmitted from the worm gear 90 to the sun gear 81 via the worm wheel 91, the torque limiter 92, and the torque limiter gear 93 by driving the motor 43, the sun gear 81 rotates. As a result, the plurality of planetary gears 82 which meshes with the sun gear 81 rotates and revolves along the internal gear 84. This revolution movement is output as rotation movement of the planetary carrier 83, so that rotation movement of the motor 43 is transmitted at a reduced speed. A driving force output from the planetary carrier 83 is transmitted to the cam 41 via a first transmission gear 94 and a second transmission gear 95.

By transmitting the driving force of the motor 43 to the cam 41 through such speed reducer 80, even if the output of the motor 43 is relatively small, the driving force may be increased to be transmitted to the cam 41. Thus, the contact-separation member may surely come closer to/separate from the counterpart member. Adopting the planetary gear deceleration mechanism as the speed reducer 80 can reduce a size of the device and to improve a degree of freedom of component layout. As in the example illustrated in FIG. 17, the torque limiter 92 is provided in the drive system, so that when a load on the motor 43 exceeds a predetermined value, the torque transmission is interrupted by the torque limiter 92, and damage to the motor 43 and gears can be prevented.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A contact-separation mechanism comprising:

a cam configured to rotate to move a contact-separation member to and from a counterpart member;

a detection target having a reference range, the detection target configured to rotate together with the cam;

a detector configured to detect presence or absence of the detection target in a detection area of the detector; and circuitry configured to:

issue a rotation stop instruction of the cam after a target time elapses from passing of the reference range of the detection target through the detection area; and set the target time based on a duration of an immediately preceding passing of the reference range through the detection area.

2. The contact-separation mechanism according to claim 1, further comprising a timer configured to measure the target time, wherein the circuitry is configured to determine, based on a timing of time measurement by the timer, a timing of the rotation stop instruction of the cam in one of moving of the contact-separation member to the counterpart member and moving of the contact-separation member from the counterpart member; and determine, based on a detection timing of the detection target by the detector, a timing of issuance of the rotation stop instruction of the cam in the other of the moving of the contact-separation member to the counterpart member and moving of the contact-separation member from the counterpart member.

3. The contact-separation mechanism according to claim 2, wherein the number of the detector is one.

4. The contact-separation mechanism according to claim 1, further comprising a direct-current motor configured to drive the cam.

5. The contact-separation mechanism according to claim 1, further comprising a planetary gear reducer configured to transmit a driving force to the cam at a reduced speed.

6. A fixing device comprising:

a fixing rotator;

a pressure rotator pressed against the fixing rotator; and the contact-separation mechanism according to claim 1, to move at least one of the fixing rotator and the pressure rotator closer to and from the other of the fixing rotator and the pressure rotator.

7. An image forming apparatus comprising:

an image forming device configured to form an image; and the contact-separation mechanism according to claim 1.

* * * * *